US010289068B2

(12) United States Patent
Satou

(10) Patent No.: US 10,289,068 B2
(45) Date of Patent: May 14, 2019

(54) IMAGE FORMATION APPARATUS

(71) Applicant: Konica Minolta, Inc., Chiyoda-ku, Tokyo (JP)

(72) Inventor: Mitsuru Satou, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 352 days.

(21) Appl. No.: 15/354,339

(22) Filed: Nov. 17, 2016

(65) Prior Publication Data

US 2017/0153598 A1 Jun. 1, 2017

(30) Foreign Application Priority Data

Nov. 26, 2015 (JP) ..... 2015-230547

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS

| | | | | |
|---|---|---|---|---|
| 6,094,549 | A * | 7/2000 | Hiraoka | G03G 15/2064 399/325 |
| 2009/0252525 | A1* | 10/2009 | Kojima | G03G 15/6573 399/92 |
| 2011/0280609 | A1* | 11/2011 | Nakazawa | G03G 21/206 399/92 |
| 2012/0177396 | A1 | 7/2012 | Pitas et al. | |

FOREIGN PATENT DOCUMENTS

| | | | | |
|---|---|---|---|---|
| JP | 2002277036 | A | 9/2002 | |
| JP | 2010280113 | A | 12/2010 | |
| JP | 2011116043 | A | 6/2011 | |
| JP | 2014186134 | A | 10/2014 | |
| JP | 2014224997 | A * | 12/2014 | G03G 15/2017 |
| JP | 2015102644 | A | 6/2015 | |
| JP | 2015172673 | A | 10/2015 | |

OTHER PUBLICATIONS

JP Notice of Grounds of Rejection corresponding to Application No. 2015-230547; dated Oct. 3, 2017.

* cited by examiner

*Primary Examiner* — Susan S Lee

(74) *Attorney, Agent, or Firm* — Cantor Colburn LLP

(57) ABSTRACT

An image formation apparatus includes: a casing; first and second heat sources disposed in the casing; a first blower blowing air toward the first heat source to cool the first heat source; and a second blower blowing air toward the second heat source to cool the second heat source. The first and second blowers are disposed to have their respective suction portions facing each other so that the air blown out via the first blower and that blown out via the second blower move away from each other. An air suction port which sucks from outside the casing the air that is blown by the first blower and an air suction port which sucks from outside the casing the air that is blown by the second blower are configured by a common air suction port.

8 Claims, 4 Drawing Sheets

IMAGE FORMATION APPARATUS

CROSS REFERENCE TO RELATED APPLICATIONS

This application is based on Japanese Patent Application No. 2015-230547 filed with the Japan Patent Office on Nov. 26, 2015, the entire content of which is hereby incorporated by reference.

BACKGROUND OF THE INVENTION

Field of the Invention

The present invention relates to an image formation apparatus, and particularly to an image formation apparatus such as a copier, a printer, and a facsimile formed such that it is provided with an image forming portion which forms an image by utilizing various types of image formation systems regardless of whether the image is a color image or a monochrome image, etc.

Description of the Related Art

In recent years, image formation apparatuses have a tendency to generate increased amounts of heat inside their bodies as their processing speeds are increased. On the other hand, there still is a strong demand for miniaturizing image formation apparatuses and it is thus necessary to make their configurations compact.

Accordingly, it is necessary to construct an in-machine air flow in a limited space for radiating heat and for some cases a plurality of blowers are disposed in a machine opposite to each other.

As an image formation apparatus having a plurality of blowers disposed in the machine opposite to each other, there is an image formation apparatus in an ink jet system disclosed in Japanese Laid-Open Patent Publication No. 2010-280113 for example. In this image formation apparatus, a pair of blowers is disposed to sandwich a controller disposed in the machine and serving as a heat source, and one blower is utilized as an exhausting blower for exhausting the controller's heat outside the machine and the other blower is used as a heating blower for utilizing the controller's heat to heat an ink. Note that this image formation apparatus is configured such that the pair of blowers are selectively driven.

Note that the image formation apparatus disclosed in Japanese Laid-Open Patent Publication No. 2010-280113 is formed such that in order to radiate in different directions the heat generated by a single heat source the pair of blowers are disposed to sandwich the single heat source. However, in contrast to such a case, there is also a case assumed in which in order to radiate heat generated by a plurality of heat sources, a plurality of blowers are disposed opposite to one another.

In that case, it is necessary to use a plurality of blowers to introduce air outside the machine (i.e., external air) into the machine and blow the introduced air via the plurality of blowers appropriately toward the plurality of heat sources, however, the plurality of opposite blowers will interfere with one other, and if this interference is not taken into consideration at all, problems arise such as reduced cooling efficiency, and, in the first place, insufficient cooling.

SUMMARY OF THE INVENTION

The present invention has been made in view of the above problems and contemplates an image formation apparatus which ensures that even when inside a casing thereof a plurality of blowers are disposed opposite to one another, a plurality of heat sources located inside the casing can be cooled while the apparatus's configuration can be compact.

An image formation apparatus according to the present invention includes: a casing; a first heat source disposed in the casing; a second heat source disposed in the casing at a position spaced from the first heat source; a first blower blowing air toward the first heat source to cool the first heat source; and a second blower blowing air toward the second heat source to cool the second heat source. The first and second blowers may at least be simultaneously driven. The first and second blowers are disposed to have their respective suction portions facing each other so that the air blown out via the first blower and the air blown out via the second blower move away from each other. In the image formation apparatus based on the present invention, an air suction port which sucks from outside the casing the air that is blown by the first blower and an air suction port which sucks from outside the casing the air that is blown by the second blower are configured by a common air suction port.

In the image formation apparatus based on the present invention, preferably, of a wall portion which defines a blower chamber in which the first blower and the second blower are disposed, a portion excluding a portion in communication with the air suction port, a portion in which the first blower is disposed, and a portion in which the second blower is disposed, is closed.

In the image formation apparatus based on the present invention, the second blower may be smaller in power than the first blower.

In the image formation apparatus based on the present invention, preferably, when the second blower is smaller in power than the first blower, a length of an air suction path from the air suction port to the second blower is shorter than a length of an air suction path from the air suction port to the first blower.

In the image formation apparatus based on the present invention, preferably, an air suction path from the air suction port to the first blower and an air suction path from the air suction port to the second blower are configured by a single path at an upstream portion in an air blowing direction, and a partitioning wall is provided between the first blower and the second blower so that at a downstream portion in the air blowing direction the air suction path from the air suction port to the first blower and the air suction path from the air suction port to the second blower are branched into a first branch path located closer to the first blower and a second branch path located closer to the second blower.

In the image formation apparatus based on the present invention, preferably, an opening area at an upstream end of the second branch path in an air blowing direction is larger than an opening area at an upstream end of the first branch path in an air blowing direction.

In the image formation apparatus based on the present invention, preferably, when the second blower is smaller in power than the first blower, then, in a direction in which the first blower and the second blower are aligned, the air suction port may be disposed at a position closer to the second blower than the first blower. In that case, when an end of the air suction port located on a side opposite to an end thereof closer to the first blower is located at least at a position on a side opposite to the first blower as seen from the suction portion of the second blower, then, preferably, in a direction orthogonal to the direction in which the first blower and the second blower are aligned, a distance between the second blower and the air suction port is larger than a distance between the first blower and the air suction port.

In the image formation apparatus based on the present invention, a wall portion having a portion provided with the air suction port may include a first metallic plate member and a second metallic plate member arranged so as to face each other with a distance therebetween, and in that case, preferably, the air suction port is composed of a throughhole provided through the first metallic plate member and a throughhole provided through the second metallic plate member. Furthermore, in that case, preferably, the throughhole provided through the first metallic plate member and the throughhole provided through the second metallic plate member are provided at alternate positions so that they do not exactly face each other.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention will now be described in embodiments hereinafter in detail with reference to the drawings. In the following embodiments, identical or common components are identically denoted in the figures and will not be described repeatedly.

Figure 1:
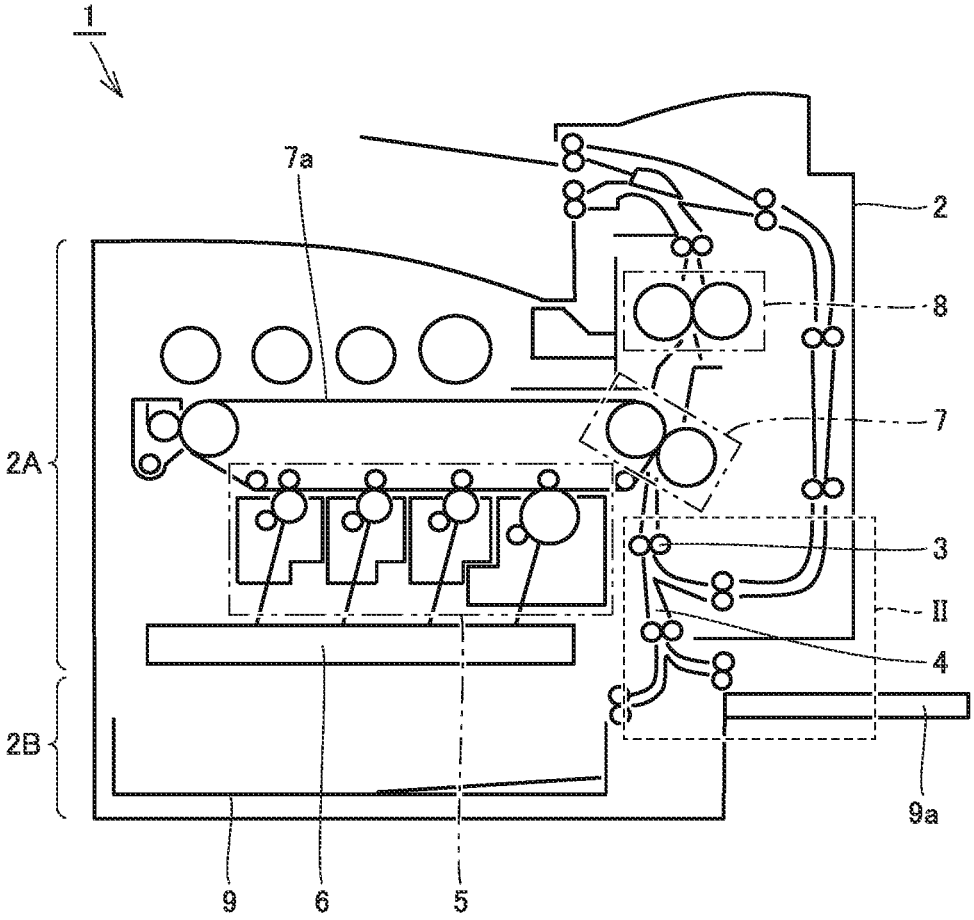
FIG. 1 is a schematic diagram of an image formation apparatus in an embodiment of the present invention.

FIG. 1 is a schematic diagram of an image formation apparatus in an embodiment of the present invention. Initially, with reference to FIG. 1, a schematic configuration of an image formation apparatus 1 in the present embodiment will be described. Note that image formation apparatus 1 exemplified in the present embodiment is a color printer of a so-called tandem type which adopts an electrophotography system.

As shown in FIG. 1, image formation apparatus 1 mainly includes an apparatus body 2 and a sheet feeding unit 9. Apparatus body 2 includes an image forming portion 2A which is a portion for forming an image on a sheet, and a sheet feeding portion 2B which is a portion for supplying image forming portion 2A with the sheet. Sheet feeding unit 9 accommodates sheets to be supplied to image forming portion 2A, and is provided in sheet feeding portion 2B detachably.

Inside image formation apparatus 1, a variety of types of rollers 3 are disposed across image forming portion 2A and sheet feeding portion 2B described above, and these rollers configure a transport path 4 to transport a sheet in a prescribed direction. Furthermore, as shown in the figure, in sheet feeding portion 2B there may be provided a manual bypass tray 9*a* separately for supplying image forming portion 2A with a sheet.

Image forming portion 2A mainly includes an imaging unit 5 which can form a toner image of each color of yellow (Y), magenta (M), cyan (C), and black (K) for example, an exposure unit 6 for exposing to light a photoreceptor included in imaging unit 5, an intermediate transfer belt 7*a* suspended in imaging unit 5, a transfer portion 7 provided on a track of intermediate transfer belt 7*a*, and a fixing portion 8 provided on transport path 4 at a portion downstream of transfer portion 7.

Imaging unit 5 receives light from exposure unit 6 and thus forms a toner image composed of each color of yellow (Y), magenta (M), cyan (C) and black (K) or a toner image of black (K) alone, and transfers the toner image to intermediate transfer belt 7*a* (i.e., a so-called primary transfer). Thus, a color toner image or a monochrome toner image will be formed on intermediate transfer belt 7*a*.

Intermediate transfer belt 7*a* transports the color or monochrome toner image formed on a surface thereof to transfer portion 7, and, together with a sheet transported from sheet feeding portion 2B to transfer portion 7, is pressed in transfer portion 7 by a pair of transfer rollers. Thus, the color or monochrome toner image formed on the surface of intermediate transfer belt 7*a* is transferred to the sheet (a so-called secondary transfer). The sheet having the color or monochrome toner image transferred thereon is subsequently pressurized and heated by fixing portion 8, and the image is thus formed on the sheet.

Note that, in image formation apparatus 1 in the present embodiment, a heating source provided to fixing portion 8 is a heating source in a so-called IH (induction heating) system, and a power supply substrate 30 for IH (see FIG. 2) for supplying the heating source with electric power is disposed in apparatus body 2 at a prescribed position. Power supply substrate 30 for IH corresponds to a heat source which generates heat while image formation apparatus 1 is in operation, and in the present embodiment it serves as a first heat source.

Furthermore, imaging unit 5 described above corresponds to a heat source which generates heat while image formation apparatus 1 is in operation, and in the present embodiment it serves as a second heat source.

Figure 2:
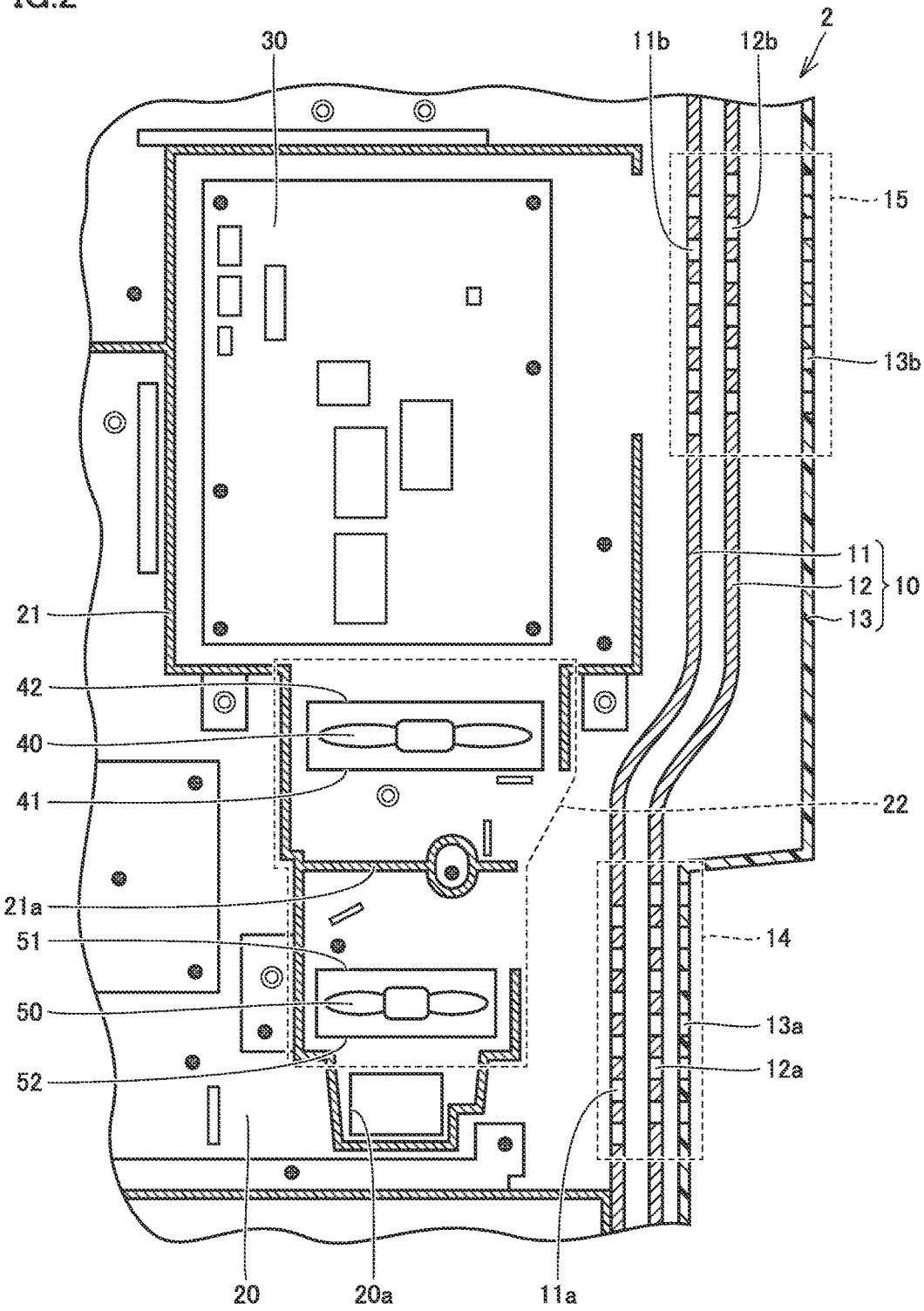
FIG. 2 is an enlarged cross section of a main portion of the image formation apparatus shown in FIG. 1.
Figure 3:
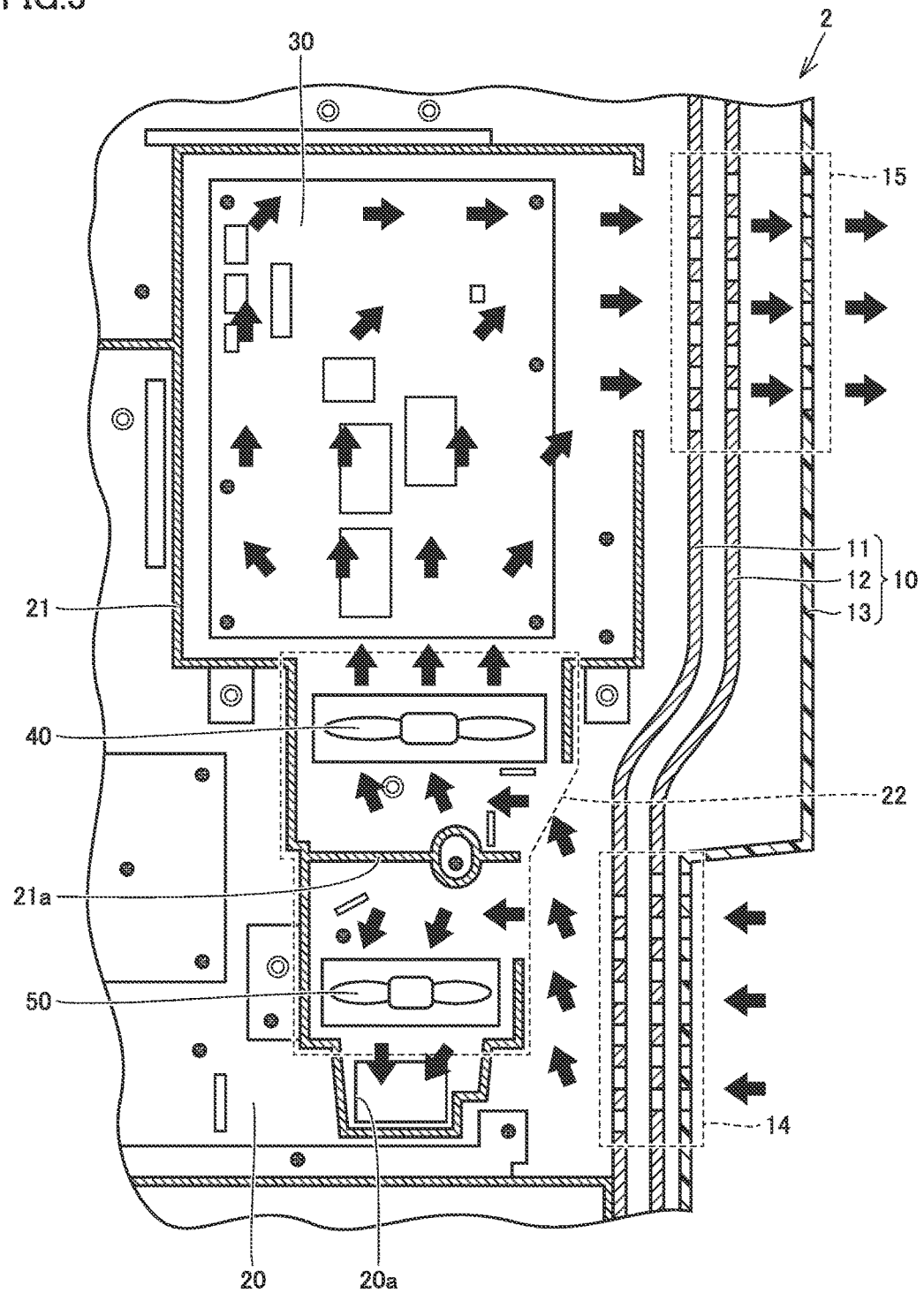
FIG. 3 is a diagram which schematically represents an in-machine air flow in the main portion of the image formation apparatus shown in FIG. 1.

FIG. 2 is an enlarged cross section of a main portion of the image formation apparatus shown in FIG. 1, and more specifically, it is an enlarged cross section of a vicinity of a blower chamber provided in a region II shown in FIG. 1. Furthermore, FIG. 3 schematically represents an in-machine air flow in the main portion of the image formation apparatus shown in FIG. 1. Hereinafter, with reference to FIGS. 2 and 3, a configuration of a vicinity of blower chamber 22 of image formation apparatus 1 in the present embodiment and the in-machine air flow will be described.

As shown in FIG. 2, apparatus body 2 of image formation apparatus 1 has a casing 10 as a shell member. Casing 10 defines a front surface, a back surface, a right side surface, a left side surface, a top surface, and a bottom surface of apparatus body 2. A portion of casing 10 that defines the right side surface of apparatus body 2 includes two metallic plate members of a first metallic plate member 11 and a second metallic plate member 12, and a decorative plate 13 which is for example a resin plate member, and a portion of casing 10 that defines the front surface of apparatus body 2 is composed of a front cover (not shown).

First metallic plate member 11, second metallic plate member 12, and decorative plate 13 defining the right side surface of apparatus body 2, as described above, are disposed in this order from inside the machine. More specifically, first metallic plate member 11 is disposed in the machine on an innermost side, decorative plate 13 is disposed in the machine on an outermost side, and second metallic plate member 12 is disposed between first metallic plate member 11 and decorative plate 13. Note that first metallic plate member 11 and second metallic plate member 12 are disposed with a distance therebetween such that they face each other at a portion provided with at least an air suction port 14 and a first exhaust port 15 described later.

Air suction port 14 and first exhaust port 15 are provided at a prescribed position of the portion of casing 10 that defines the right side surface of apparatus body 2. Air suction port 14 and first exhaust port 15 are disposed at a position on a right side of blower chamber 22 described later, and first exhaust port 15 is positioned above air suction port 14 and thus spaced therefrom. Note that a second exhaust port (not shown) is provided at a prescribed position of a portion of casing 10 that defines the back surface of apparatus body 2. First exhaust port 15 and the second exhaust port (not shown) are both provided to allow air (external air) sucked into the machine via air suction port 14 to be finally exhausted outside the machine.

First exhaust port 15 and the second exhaust port provided to the right side surface and back surface, respectively, of apparatus body 2 can prevent a user who stands in front of image formation apparatus 1 to operate image formation apparatus 1 from being directly exposed to exhaust air, and can thus suppress unpleasantness otherwise experienced by the user.

Air suction port 14 is composed of a plurality of throughholes 11*a* provided through first metallic plate member 11, a plurality of throughholes 12*a* provided through second metallic plate member 12, and a plurality of throughholes 13*a* provided through decorative plate 13. Note that throughholes 11*a*-13*a* may be a circle, a slit or other forms in a plan view.

Preferably, throughhole 11*a* provided through first metallic plate member 11 and throughhole 12*a* provided through second metallic plate member 12 are provided at alternate positions so that they do not exactly face each other. By this configuration, if decorative plate 13 should be damaged by an external impact etc., apparatus body 2 will never have an internal space externally directly exposed, which can prevent the user from inadvertently putting his/her fingers etc. into the interior of apparatus body 2, and thus ensure safety.

First exhaust port 15 is composed of a plurality of throughholes 11*b* provided through first metallic plate member 11, a plurality of throughholes 12*b* provided through second metallic plate member 12, and a plurality of throughholes 13*b* provided through decorative plate 13. Note that throughholes 11*b*-13*b* may be a circle, a slit or other forms in a plan view.

Preferably, throughhole 11*b* provided through first metallic plate member 11 and throughhole 12*b* provided through second metallic plate member 12 are provided at alternate positions so that they do not exactly face each other. By this configuration, as well as in the case of air suction port 14 described above, if decorative plate 13 should be damaged by an external impact etc., apparatus body 2 will never have an internal space externally directly exposed, which can prevent the user from inadvertently putting his/her fingers etc. into the interior of apparatus body 2, and thus ensure safety.

Note that the second exhaust port described above, as well as first exhaust port 15, is also preferably composed of a plurality of throughholes provided through a pair of metallic plate members at alternate positions.

Blower chamber 22 is provided inside casing 10. Blower chamber 22 is disposed in an internal space of apparatus body 2 at a portion closer to the front surface and the right side surface, and, with reference to the figure, it is defined by a chassis 20 located on a depthwise side of apparatus body 2, a front cover (not shown) located on a front side of apparatus body 2, and a frame 21 positioned between chassis 20 and the front cover to partition a space located therebetween.

Inside blower chamber 22, a first blower 40 and a second blower 50 are disposed, and first blower 40 and second blower 50 are vertically spaced such that they are opposite to each other. More specifically, first blower 40 is disposed at a position closer to an upper end of blower chamber 22, and second blower 50 is disposed at a position closer to a lower end of blower chamber 22.

First blower 40 is composed for example of an axial fan, and it has a suction portion 41 on one end side of its rotation axis and a discharge portion 42 on the other end side of its rotation axis. First blower 40 is disposed to have its rotation axis extending in the vertical direction, and has suction portion 41 facing downward and discharge portion 42 facing upward.

Second blower 50 is composed for example of an axial fan, and it has a suction portion 51 on one end side of its rotation axis and a discharge portion 52 on the other end side of its rotation axis. Second blower 50 is disposed to have its rotation axis extending in the vertical direction, and has suction portion 51 facing upward and discharge portion 52 facing downward.

Thus, first and second blowers 40 and 50 are disposed to have their respective suction portions 41 and 51 facing each other so that the air blown out via first blower 40 and that blown out via second blower 50 move away from each other.

Above blower chamber 22, power supply substrate 30 for IH as the above described first heat source is disposed. Power supply substrate 30 for IH is disposed on a left side of first exhaust port 15 provided to casing 10 such that power supply substrate 30 for IH is in communication with first exhaust port 15.

Below blower chamber 22, an opening 20*a* is provided that serves as an entrance to a communication path in communication with imaging unit 5 serving as the above described second heat source. Opening 20*a* is formed through chassis 20, and the above described communication path extends toward the depthwise side of apparatus body 2. Note that although not shown in the figure, imaging unit 5 is disposed such that it is adjacent to the communication path, and further downstream thereof, imaging unit 5 is in communication with the above described second exhaust port.

In image formation apparatus 1 configured in this way, as shown in FIG. 3, of first and second blowers 40 and 50 disposed opposite to each other, first blower 40 will introduce air (external air) through air suction port 14 and blow the air toward power supply substrate 30 for IH disposed in casing 10 and serving as the first heat source, and thereby cool power supply substrate 30 for IH, and second blower 50 will introduce air (external air) through air suction port 14 and blow the air toward imaging unit 5 serving as the second heat source disposed in casing 10 at a position spaced from power supply substrate 30 for IH serving as the above described first heat source, and thereby cool imaging unit 5.

In other words, the air suction port which sucks from outside casing 10 the air that is blown by first blower 40 and the air suction port which sucks from outside casing 10 the air that is blown by second blower 50 are configured by a common air suction port 14, and this common air suction port eliminates the necessary of providing an extra air suction port, which can save space and make the apparatus's configuration compact, and also ensures that power supply substrate 30 for IH and imaging unit 5 are cooled. Furthermore, such a configuration also allows a design with a reduced proportion of the air suction port occupying an external surface of casing 10, and hence more suitably.

Note that the air blown by first blower 40 to power supply substrate 30 for IH and thus having received the heat of power supply substrate 30 for IH, is exhausted outside apparatus body 2 via first exhaust port 15. Thus, power supply substrate 30 for IH is cooled appropriately. Furthermore, the air blown by second blower 50 to imaging unit 5 and thus having received the heat of imaging unit 5, is exhausted outside apparatus body 2 via the second exhaust port. Thus, imaging unit 5 is cooled appropriately.

Note that when image formation apparatus 1 is in operation, as has been discussed previously, power supply substrate 30 for IH and imaging unit 5 normally both generate heat, and accordingly, first blower 40 and second blower 50 are driven simultaneously for most of the time. Strictly, however, it is not necessary to drive first blower 40 and second blower 50 constantly simultaneously, and they may be driven at least simultaneously.

Figure 4:
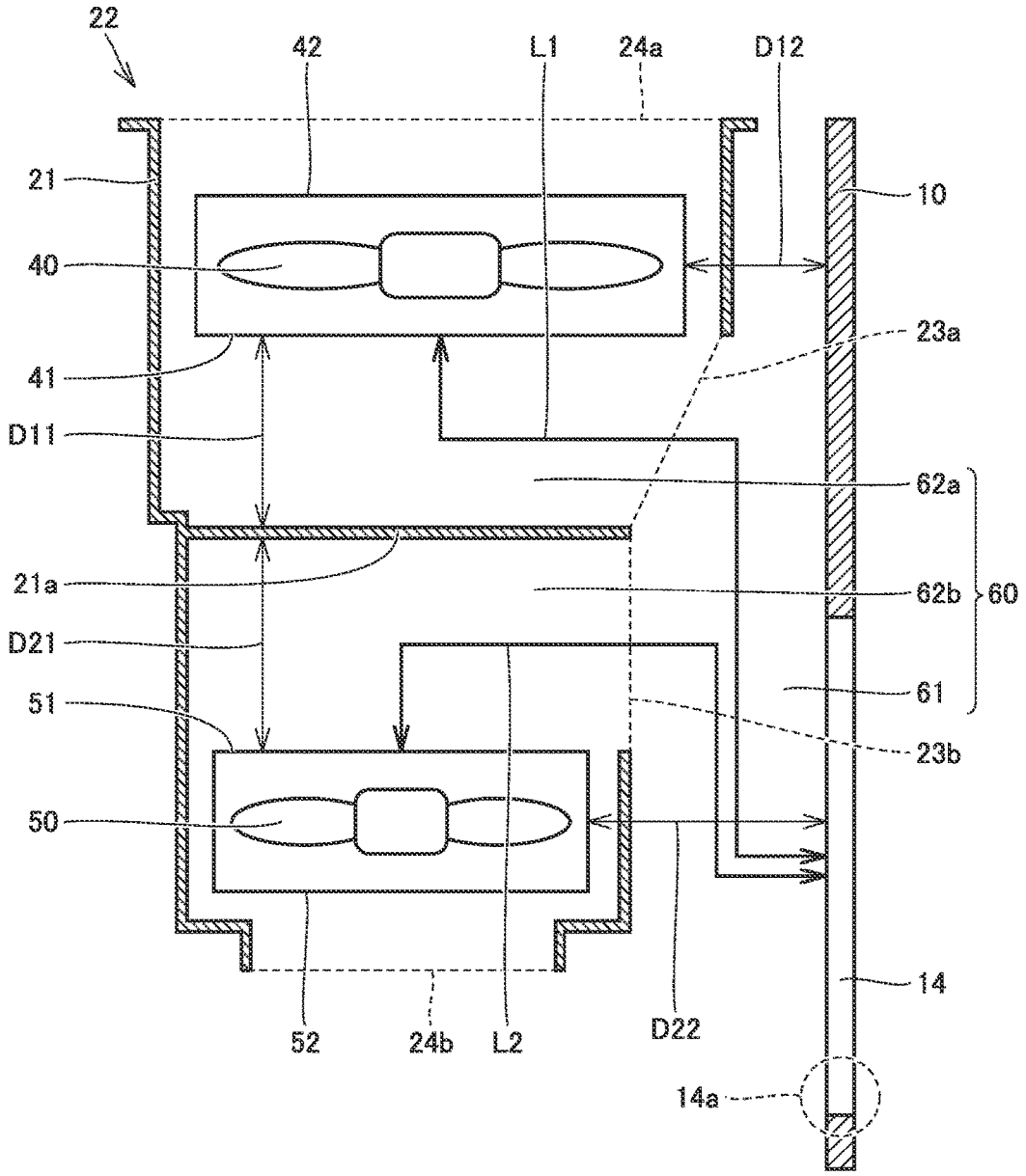
FIG. 4 is an enlarged schematic cross section in a vicinity of a blower chamber shown in FIG. 2.

FIG. 4 is an enlarged schematic cross section of the blower chamber shown in FIG. 2. Hereinafter, with reference to FIG. 4, a configuration of a vicinity of blower chamber 22 of image formation apparatus 1 in the present embodiment will be described more specifically. Note that in FIG. 4, in order to facilitate understanding, casing 10 and air suction port 14 provided thereto are shown in a simplified manner As shown in FIG. 4, a portion of frame 21 that defines blower chamber 22 is provided with a first inlet 23*a*, a second inlet 23*b*, a first outlet 24*a*, and a second outlet 24*b*.

First inlet 23*a* and second inlet 23*b* are provided to a right side portion of frame 21 defining blower chamber 22 such that they both face a portion of casing 10 provided with air suction port 14. Herein, first inlet 23*a* is provided at an upper portion of the right side portion of frame 21 to correspond to first blower 40 disposed at the upper end of blower chamber 22, and second inlet 23*b* is provided at a lower portion of the right side portion of frame 21 to correspond to second blower 50 disposed at the lower end of blower chamber 22.

In contrast, first outlet 24*a* is provided at an upper portion of frame 21 defining blower chamber 22 so that first outlet 24*a* faces discharge portion 42 of first blower 40, and second outlet 24*b* is provided at a lower portion of frame 21 defining blower chamber 22 so that second outlet 24*b* faces discharge portion 52 of second blower 50.

By this configuration, an air suction path 60 will be formed at a portion between the portion of casing 10 provided with air suction port 14 and first and second blowers 40 and 50, and when first blower 40 and second blower 50 are driven, air sucked from outside casing 10 via air suction port 14 reaches first blower 40 and second blower 50 via air suction path 60.

Note that a portion of chassis 20, frame 21 and a front panel (not shown) that defines blower chamber 22 is not provided with an opening except for first inlet 23*a*, second inlet 23*b*, first outlet 24*a*, and second outlet 24*b*. In other words, of a wall portion which defines blower chamber 22 in which first blower 40 and second blower 50 are disposed, a portion excluding first inlet 23*a* and second inlet 23*b* that are portions in communication with air suction port 14, first outlet 24*a* that is a portion in which first blower 40 is disposed, and second outlet 24*b* that is a portion in which second blower 50 is disposed, is all closed.

This configuration ensures that the air introduced into blower chamber 22 via first inlet 23*a* and second inlet 23*b* will pass through first blower 40 and second blower 50 and be blown without leaking from blower chamber 22 to another portion, and power supply substrate 30 for IH as the first heat source and imaging unit 5 as the second heat source can be efficiently cooled. Furthermore, this configuration can also minimize an effect on other internal components disposed around blower chamber 22.

Inside blower chamber 22 at a position between first blower 40 and second blower 50, a portion of frame 21 is extended to provide a partitioning wall 21*a*. Partitioning wall 21*a* is for interrupting first blower 40 and second blower 50 so that they do not directly face each other.

Note that, in the present embodiment, between the portion of casing 10 provided with air suction port 14 and blower chamber 22, a member or wall portion which interrupts them is not disposed in particular. Accordingly, an air suction path from air suction port 14 to first blower 40 and an air suction path from air suction port 14 to second blower 50 will be configured by a common path 61 which is a single path in an upstream portion of air suction path 60 in the air blowing direction.

In contrast, a downstream portion of air suction path 60 in the air blowing direction is provided with partitioning wall 21*a* so that the air suction path from air suction port 14 to first blower 40 and the air suction path from air suction port 14 to second blower 50 are branched into a first branch path 62*a* located closer to first blower 40 and a second branch path 62*b* located closer to second blower 50.

More specifically, the air suction path of first blower 40 is composed of common path 61 and first branch path 62*a*, and the air suction path of second blower 50 is composed of common path 61 and second branch path 62*b*.

Thus, partitioning wall 21*a* provided between first blower 40 and second blower 50 can suppress interference of first blower 40 and second blower 50 with each other. More specifically, not only can it suppress noise increased as wind noise is amplified by resonance, but it can also balance an amount of air sucked via air suction port 14 that reaches first blower 40 and an amount of air sucked via air suction port 14 that reaches second blower 50 and thus prevent one blower and the other blower from blowing air in an increased amount and a decreased amount, respectively. Hereinafter, the latter's flow adjustment function will more specifically be described according to the present embodiment.

Normally, a blower's power is set considering an amount of heat generated by a heat source to be cooled, a flow resistance in an air passageway up to the heat source, etc. Accordingly, two blowers disposed in a casing opposite to each other are not necessarily of the same power. For example, in image formation apparatus 1 in the present embodiment, the above described amount of heat generated, flow resistance, etc. are taken into consideration, and as a result second blower 50 is configured to be smaller in power than first blower 40.

In that case, an in-machine air flow will significantly vary depending on where and how partitioning wall 21*a* is provided, and accordingly, in the present embodiment the following configuration is adopted to optimize it.

With reference to FIG. 4, in image formation apparatus 1 in the present embodiment, firstly, a length L2 of the air suction path from air suction port 14 to second blower 50 is configured to be shorter than a length L1 of the air suction path from air suction port 14 to first blower 40. A length of an air suction path as referred to herein is, as shown in the figure, a length of a centerline connecting a center point in the air suction path from an upstream side (more specifically, the air suction port 14 side) to a downstream side (more specifically, the first blower 40 side or the second blower 50 side).

Length L1 of the air suction path of first blower 40 and length L2 of the air suction path of second blower 50 are determined mainly by where partitioning wall 21*a* is disposed, i.e., a distance D11 between partitioning wall 21*a* and first blower 40 and a distance D21 between partitioning wall 21*a* and second blower 50. Accordingly, by appropriately adjusting where partitioning wall 21*a* is disposed, length L2 of the air suction path of second blower 50 can be easily set to be shorter than length L1 of the air suction path of first blower 40.

By this configuration, more of air sucked via air suction port 14 can be introduced into second blower 50 having a smaller power, so that an amount of air sucked via air suction port 14 that reaches first blower 40 and an amount of air sucked via air suction port 14 that reaches second blower 50 can be balanced, which can prevent one blower and the other blower from blowing air in an increased amount and a decreased amount, respectively.

Furthermore, in image formation apparatus 1 in the present embodiment, secondly, an opening area at an upstream end of second branch path 62*b* in the air blowing direction (i.e., an opening area of second inlet 23*b*) is larger than an opening area at an upstream end of first branch path 62*a* in the air blowing direction (i.e., an opening area of first inlet 23*a*).

The opening area of first inlet 23*a* and the opening area of second inlet 23*b* are determined mainly by where partitioning wall 21*a* is disposed, i.e., distance D11 between partitioning wall 21*a* and first blower 40 and distance D21 between partitioning wall 21*a* and second blower 50. Accordingly, by appropriately adjusting where partitioning wall 21*a* is disposed, the opening area of second inlet 23*b* can be easily set to be larger than the opening area of first inlet 23*a*.

By this configuration, more of air sucked via air suction port 14 can be introduced into second blower 50 having a smaller power, so that an amount of air sucked via air suction port 14 that reaches first blower 40 and an amount of air sucked via air suction port 14 that reaches second blower 50 can be balanced, which can prevent one blower and the other blower from blowing air in an increased amount and a decreased amount, respectively.

Thus image formation apparatus 1 in the present embodiment not only allows first blower 40 having larger power to efficiently cool power supply substrate 30 for IH while making the apparatus's configuration compact, but also allows second blower 50 having smaller power to efficiently cool imaging unit 5.

Furthermore, in image formation apparatus 1 in the present embodiment, in a direction in which first blower 40 and second blower 50 are aligned (more specifically, a vertical direction) air suction port 14 is disposed at a position closer to second blower 50 than first blower 40 and, as seen from suction portion 51 of second blower 50, an end 14*a* of air suction port 14 located on a side opposite to first blower 40 is located at a position on a side opposite to first blower 40, and furthermore, in a direction orthogonal to the direction in which first blower 40 and second blower 50 are aligned (more specifically, a horizontal direction), distance D22 between second blower 50 and air suction port 14 is larger than distance D12 between first blower 40 and air suction port 14.

Normally, when air suction port 14 is disposed at a position closer to second blower 50 than first blower 40 in the direction in which first blower 40 and second blower 50 are aligned (more specifically, the vertical direction), more of air sucked via air suction port 14 will be introduced into second blower 50, however, when end 14*a* of air suction port 14 located on the side opposite to first blower 40 is located at a position on the side opposite to first blower 40 as seen from suction portion 51 of second blower 50, as has been discussed above, air suction efficiency at a position closer to end 14*a* of air suction port 14 drops and efficient air suction cannot be performed.

However, in this case, in the direction orthogonal to the direction in which first blower 40 and second blower 50 are aligned (more specifically, the horizontal direction), distance D22 between second blower 50 and air suction port 14 is configured to be larger than distance D12 between first blower 40 and air suction port 14, as has been discussed above, and a sufficient space is formed between end 14*a* of air suction port 14 and second blower 50, which allows second blower 50 having small power to nonetheless actively suck air from a position close to end 14*a* of air suction port 14 and can thus enhance entire air suction efficiency.

Thus image formation apparatus 1 in the present embodiment not only ensures that power supply substrate 30 for IH and imaging unit 5 are cooled while making the apparatus's configuration compact, but also allows entire cooling efficiency to be also sufficiently enhanced.

While the embodiment of the present invention described above has been described by indicating by way of example a case in which a blower chamber is configured such that blowers disposed therein opposite to each other have their respective rotation axes both extending in the vertical direction, this configuration is not a requirement and the blower chamber may be configured such that the blowers disposed opposite to each other may have their respective rotation axes extending in the apparatus body's frontward and backward direction, rightward and leftward direction, etc.

Furthermore, while the embodiment of the present invention described above has been described by indicating by way of example a case in which blowers disposed opposite to each other have their respective rotation axes in parallel (i.e., the blowers are disposed exactly opposite to each other), this configuration is not a requirement and the blowers disposed opposite to each other may have their respective rotation axes disposed in non-parallel as long as the blowers have their respective suction portions opposite to each other.

While the embodiment of the present invention described above has been described by indicating by way of example a case in which blowers disposed opposite to each other are each an axial fan, this configuration is not a requirement and one or both of the blowers disposed opposite to each other may be a blower/blowers other than the axial fan (e.g., a centrifugal fan(s), a mixed flow fan(s), a cross flow fan(s), etc.).

Furthermore, while the embodiment of the present invention described above has been described by indicating by way of example a case in which the present invention is applied to an air blowing mechanism for cooling a power supply substrate for IH and an imaging unit, the present invention is applicable to any air blowing mechanism for cooling a heat source which will be included in an image formation apparatus. In that case, assumed as a combination of heat sources is a combination of two or more heat sources selected from a variety of types of substrates (a controller substrate, a power supply substrate for IH, a constant voltage power supply substrate, a high voltage power supply substrate, a substrate for driving transporting a fed sheet etc.), a variety of types of motors (a motor for driving a transfer roller, a motor for driving a fixing roller, a motor for driving sheet transportation, a motor for driving a PC, etc.), an IH coil, an imaging unit (DV/DR), a PH, a transfer portion, a fixing portion, a scanner, etc. Furthermore, other than the above, the present invention is also applicable to an air blowing mechanism including a blower for cooling a heated sheet.

Furthermore, while the embodiment of the present invention described above has been described by indicating by way of example a case in which the present invention is applied to an image formation apparatus which forms an image by utilizing an electrophotography system, the present invention is also applicable as a matter of course to an image formation apparatus which forms an image by utilizing a different image formation system such as an ink jet system.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. An image formation apparatus comprising:

a casing;

a first heat source disposed in the casing;

a second heat source disposed in the casing at a position spaced from the first heat source;

a first blower blowing air toward the first heat source to cool the first heat source; and a second blower blowing air toward the second heat source to cool the second heat source;

the first and second blowers being simultaneously driven at least occasionally, the first and second blowers being disposed to have their respective suction portions facing each other so that air blown out via the first blower and air blown out via the second blower move away from each other, an air suction port which sucks air that is blown by the first blower from outside the casing and an air suction port which sucks air that is blown by the second blower from outside the casing being configured by a common air suction port.

2. The image formation apparatus according to claim 1, wherein, of a wall portion which defines a blower chamber in which the first blower and the second blower are disposed, a portion excluding a portion in communication with the air suction port, a portion in which the first blower is disposed, and a portion in which the second blower is disposed, is closed.

3. The image formation apparatus according to claim 1, wherein the second blower is smaller in power than the first blower.

4. The image formation apparatus according to claim 3, wherein a length of an air suction path from the air suction port to the second blower is shorter than a length of an air suction path from the air suction port to the first blower.

5. The image formation apparatus according to claim 3, wherein an air suction path from the air suction port to the first blower and an air suction path from the air suction port to the second blower are configured by a single path at an upstream portion in an air blowing direction, and a partitioning wall is provided between the first blower and the second blower so that at a downstream portion in the air blowing direction the air suction path from the air suction port to the first blower and the air suction path from the air suction port to the second blower are branched into a first branch path located closer to the first blower and a second branch path located closer to the second blower.

6. The image formation apparatus according to claim 5, wherein an opening area at an upstream end of the second branch path in an air blowing direction is larger than an opening area at an upstream end of the first branch path in an air blowing direction.

7. The image formation apparatus according to claim 3, wherein:

in a direction in which the first blower and the second blower are aligned, the air suction port is disposed at a position closer to the second blower than the first blower;

an end of the air suction port located on a side opposite to an end thereof closer to the first blower is located at least at a position on a side opposite to the first blower as seen from the suction portion of the second blower; and in a direction orthogonal to the direction in which the first blower and the second blower are aligned, a distance between the second blower and the air suction port is larger than a distance between the first blower and the air suction port.

8. The image formation apparatus according to claim 1, wherein:

a wall portion having a portion provided with the air suction port includes a first metallic plate member and a second metallic plate member arranged so as to face each other with a distance therebetween;

the air suction port is composed of a throughhole provided through the first metallic plate member and a throughhole provided through the second metallic plate member; and the throughhole provided through the first metallic plate member and the throughhole provided through the second metallic plate member are provided at alternate positions so that they do not exactly face each other.

* * * * *